US007814733B2

(12) United States Patent
Carlson et al.

(10) Patent No.: US 7,814,733 B2
(45) Date of Patent: Oct. 19, 2010

(54) PACKAGING SYSTEM WITH VOLUME MEASUREMENT

(75) Inventors: Daniel L. Carlson, Ravenna, OH (US); Thomas A. Bilkie, Medina, OH (US)

(73) Assignee: Ranpak Corp., Concord Township, OH (US)

( * ) Notice: Subject to any disclaimer, the term of this patent is extended or adjusted under 35 U.S.C. 154(b) by 8 days.

(21) Appl. No.: 12/296,726

(22) PCT Filed: Apr. 10, 2007

(86) PCT No.: PCT/US2007/066311

§ 371 (c)(1),
(2), (4) Date: Oct. 10, 2008

(87) PCT Pub. No.: WO2007/121169

PCT Pub. Date: Oct. 25, 2007

(65) Prior Publication Data

US 2009/0173040 A1 Jul. 9, 2009

Related U.S. Application Data

(60) Provisional application No. 60/744,595, filed on Apr. 10, 2006.

(51) Int. Cl.
*B65B 23/00* (2006.01)

(52) U.S. Cl. ..... 53/472; 53/55; 53/504; 53/267; 493/25

(58) Field of Classification Search ..... 53/468, 53/472, 115, 52, 55, 239, 267, 271, 503–505; 493/25, 967
See application file for complete search history.

(56) References Cited

U.S. PATENT DOCUMENTS 2,309,760 A * 2/1943 First ..... 53/449

(Continued)

FOREIGN PATENT DOCUMENTS

WO 01/94107 12/2001

(Continued)

OTHER PUBLICATIONS

International Search Report dated Nov. 5, 2007, from International Application No. PCT/US2007/066311, filed Apr. 10, 2007, published as International Publication No. WO 2007/121169.

*Primary Examiner*—Paul R Durand
(74) *Attorney, Agent, or Firm*—Renner, Otto, Boisselle & Sklar, LLP

(57) ABSTRACT

A system, and associated components and methodology, that automatically acquires data representative of the space left in each of a series of containers (32) in which one or more articles have been placed for packaging, and dispenses a controlled amount of dunnage material based on that data from a selected one of a plurality of dunnage dispensers (12). The system includes void volume data acquisition apparatus (11) for acquiring void volume data for the containers sequentially supplied thereto and for associating the sequentially acquired void volume data with the container. The system also includes a plurality of dunnage dispensers remotely located relative to the void volume data acquisition apparatus to dispense a controlled amount of dunnage material for insertion into one of the containers selectively transported to that dispenser from the void volume data acquisition apparatus.

18 Claims, 6 Drawing Sheets

U.S. PATENT DOCUMENTS

| | | | | | |
|---|---|---|---|---|---|
| 3,667,593 | A | * | 6/1972 | Pendleton | 206/584 |
| 4,202,387 | A | * | 5/1980 | Upton | 141/360 |
| 4,905,512 | A | * | 3/1990 | Hayashi | 73/169 |
| 4,922,687 | A | * | 5/1990 | Chow et al. | 53/472 |
| 5,123,889 | A | | 6/1992 | Armington et al. | |
| 5,178,196 | A | * | 1/1993 | Garacci | 141/67 |
| 5,236,507 | A | * | 8/1993 | Brown | 118/707 |
| 5,331,118 | A | * | 7/1994 | Jensen | 177/25.14 |
| 5,544,468 | A | * | 8/1996 | Harrison et al. | 53/390 |
| 5,623,815 | A | * | 4/1997 | Hornstein et al. | 53/472 |
| 5,719,678 | A | * | 2/1998 | Reynolds et al. | 356/627 |
| 5,811,145 | A | * | 9/1998 | Morikawa | 426/503 |
| 5,871,429 | A | | 2/1999 | Harding et al. | |
| RE36,501 | E | | 1/2000 | Hoover et al. | |
| 6,055,795 | A | * | 5/2000 | Harding et al. | 53/503 |
| 6,349,526 | B1 | * | 2/2002 | Newman | 53/446 |
| 6,672,037 | B2 | * | 1/2004 | Wehrmann | 53/472 |
| 6,955,029 | B2 | * | 10/2005 | Palumbo | 53/469 |
| 2003/0114288 | A1 | * | 6/2003 | Harding et al. | 493/464 |
| 2005/0050848 | A1 | * | 3/2005 | Harding | 53/58 |

FOREIGN PATENT DOCUMENTS

| | | |
|---|---|---|
| WO | 2004/041653 | 5/2004 |
| WO | 2006/017602 | 2/2006 |

* cited by examiner

PACKAGING SYSTEM WITH VOLUME MEASUREMENT

This application is a national phase of International Patent Application No. PCT/US2007/066311, filed Apr. 10, 2007, published in English as Publication No. WO 2007/121169 A2, which claims the benefit of U.S. Provisional Application No. 60/744,595, filed Apr. 10, 2006, which are hereby incorporated herein by reference.

FIELD OF THE INVENTION

This invention relates generally to a packaging system for providing a controlled quantity of dunnage material for insertion into containers in which one or more articles are to be packed for shipping.

BACKGROUND

In the process of shipping one or more articles in a container from one location to another, a protective packaging material or other type of dunnage typically is placed in the container to fill any voids and/or to cushion the article during transport. Some commonly used dunnage materials are plastic foam peanuts, plastic bubble pack, air bags and converted paper dunnage material.

In many instances, the dunnage material is used to top-fill a container in which an article has been placed, thereby filling any remaining void in the container and thus preventing or minimizing any shifting movement of the article in the container during shipment. Automated dispensers include, for example: plastic peanut dispensers, which are often associated with an air delivery system; foam-in-place dispensers, air bag machines and paper dunnage converters.

U.S. Pat. No. 5,871,429 discloses a packaging system with a probe for sensing the void in a container and a dunnage converter having a controller for controlling the feeding and cutting of a strip of dunnage material such that the amount of dunnage material produced is the amount needed to fill the void in the container.

SUMMARY

An exemplary system, and associated components and methodology, for sequentially supplied containers automatically acquires data representative of the void volume in a container, and dispenses a controlled amount of dunnage based on that data from a supply of dunnage. The void volume is space left in a container in which one or more articles have been placed for packaging.

One particular packaging system for providing dunnage material for insertion into containers includes a void volume data acquisition apparatus for acquiring from each of a plurality of containers sequentially supplied thereto, void volume data from which can be determined a prescribed amount of dunnage material for insertion into the container, and for associating the acquired void volume data with the container. The system also includes a dunnage dispenser operable to dispense dunnage material for insertion into a container transported thereto from the void volume data acquisition apparatus, and an input device for indexing the void volume data for a next container. Each dunnage dispenser is controlled to dispense for insertion into the transported container the prescribed amount of dunnage material determined from the acquired void volume data associated with the transported container.

The system may include a transport network for conveying containers from the void volume data acquisition device to the dunnage dispenser. Accordingly, a conveyor may extend from the void volume data acquisition apparatus to the dunnage dispenser for transporting the containers thereto.

The void volume acquisition apparatus may include a sensor for identifying a characteristic of the container, a container identification sensor for identifying containers and/or a void volume scanner positioned adjacent the container identification sensor that is capable of measuring dimensions representative of the void in the container.

The dunnage dispenser may include a supply of dunnage having at least one of air bags, crumpled paper, foam strips, foam peanuts, and paper strips. The dunnage dispenser may include a conversion machine that converts a stock material into the dunnage material.

The system may also include at least one controller that determines the amount of dunnage material to be dispensed based on the void volume data, the controller being in a chain of communication between the void volume data acquisition apparatus and the dunnage dispenser. The input device may include at least one foot pedal.

A packaging method for providing dunnage material for insertion into containers includes the following steps: acquiring void volume data associated with a container and from which can be determined a prescribed amount of dunnage material for insertion into the container, and transporting the container to a dispenser of dunnage material. Upon a first signal from an input device, the method includes the step of automatically dispensing the prescribed amount of dunnage material for insertion into the transported container; and upon a second signal from an input device, the method includes the step of manually dispensing a quantity of dunnage material for insertion into the transported container.

The step of acquiring void volume data may include sensing the dimensions of the container and sensing a contour of an interior surface of the container and any articles placed therein. The step of acquiring void volume data may include identifying characteristics of the container and consulting a database to determine the void volume.

The dispensing step may include converting a stock material into a dunnage product, including converting a sheet material into the relatively less dense dunnage material.

The method may also include storing and retrieving void volume data from an electronic data storage device, and/or communicating between a void volume data acquisition apparatus and a dunnage dispenser.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

DETAILED DESCRIPTION

Figure 1:
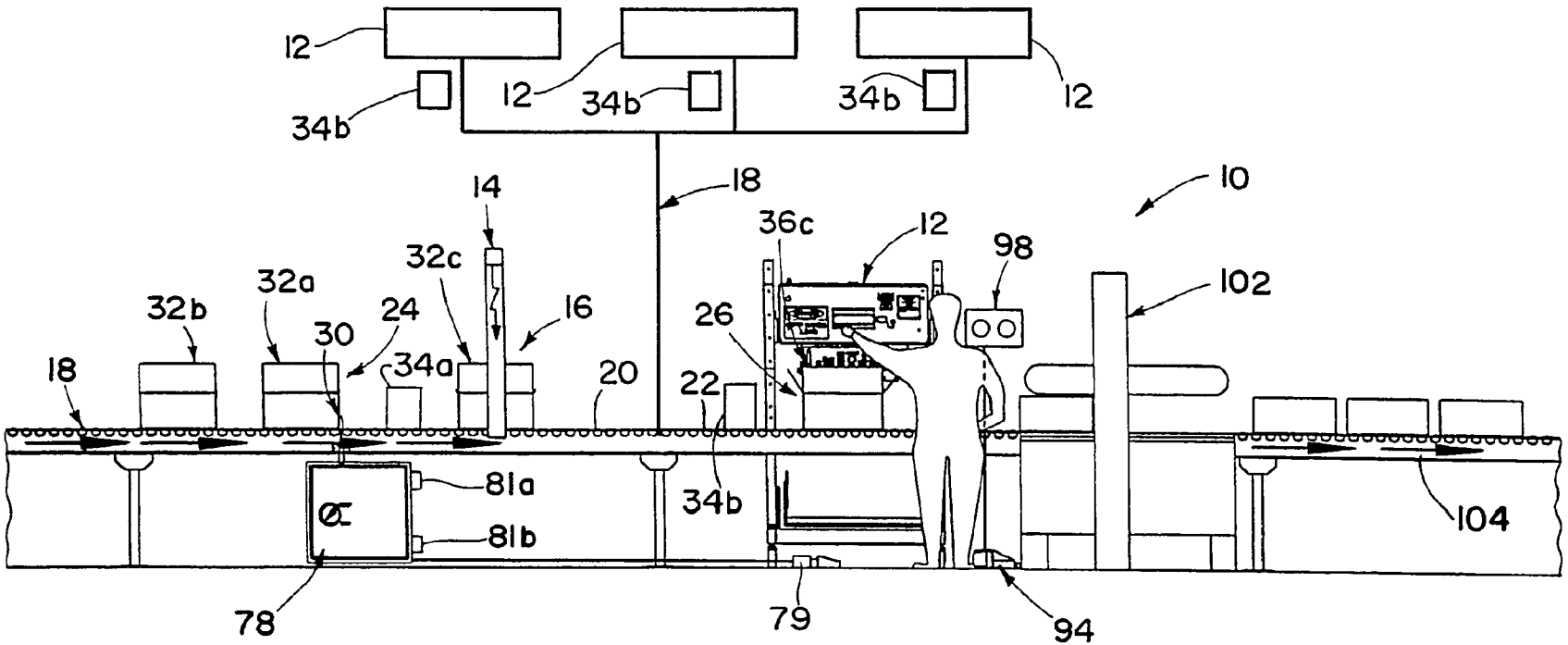
FIG. 1 is a schematic illustration of an exemplary packaging system for providing dunnage material for insertion into a container.

Referring now in detail to the drawings and initially to FIG. 1, an exemplary packaging system is indicated generally at 10. The system 10 is operative to automatically acquire data representative of the void or empty space left in each of a series of sequentially supplied containers in which one or more articles have been placed for packaging, and to dispense a controlled amount of dunnage material based on that sequentially acquired data for respective containers.

The system 10 generally includes a void volume data acquisition apparatus, generally identified at 11, that receives a series of containers 32 and sequentially acquires void volume data associated with respective containers. The void volume data acquisition apparatus 11 includes a container void volume scanner 14 having a scan area 16. The system 10 also includes at least one dunnage dispenser 12 that is operable to dispense a controlled amount of a dunnage material. The system shown in FIG. 1 includes a plurality of dunnage dispensers 12 arranged along a transport network downstream of the void volume data acquisition apparatus 11, one branch of the network being shown in more detail.

The transport network in the illustrated system 10 includes a container conveyor 18. The illustrated container conveyor 18 has a powered section 20 and an unpowered section 22. In the illustrated embodiment, the powered section 20 extends at least from a container holding station 24, through the scan area 16 to the unpowered section 22. The unpowered section 22 extends from the powered section 20 through a dunnage fill or packing area 26 proximate the dunnage dispenser 12.

The conveyor 18 can be of any suitable type, such as the illustrated roller conveyor or a zero pressure accumulating conveyor, for example. A zero pressure accumulating conveyor is a conveyor that has been divided into multiple zones, each of which typically includes one container. The containers move from one zone to the next as the downstream zone clears. Each zone can be powered separately, and sensors can be used to determine when a container has left a zone. A supervising controller typically controls the operation of each zone.

At the holding station 24 the illustrated conveyor 18 has associated therewith a stop gate 30 of any suitable type for controllably permitting passage of containers into the scan area 16. Specifically, the illustrated stop gate 30 is a retractable stop member which in an extended position will block passage of a container 32*a* and thereby hold the container 32*a* at the holding station. When the stop member 30 is retracted, the powered section 20 of the conveyor 18 moves the container 32*a* out of the holding station 24. Shortly after the container 32*a* is released from the holding station 24, the stop member 30 is extended to capture and hold the next container 32*b* at the holding station 24. The powered section 20 of the conveyor 18 transports the containers past a container identification sensor 34*a* between the stop gate 30 and the container scanner 14.

Each container 32 includes a unique identifier that can be used to identify the container and can be detected by the container identification sensor 34*a*. The identifier can take any form including a label, hardware identifiers embedded in the container, radio frequency identification (RFID) tags, etc. Exemplary identifiers are in the form of bar code labels attached to a side of the container. The container identification sensor 34*a* senses the identifier to identify a particular container 32 and output container identification data. This allows the system to associate void volume data obtained from the container scanner 14 with the container identification data for that container. Although the illustrated container identification sensor 34*a* is adjacent an upstream side of the container scanner 14, it can be placed on the downstream side of the container scanner 14, or can be integrated into the container scanner 14.

Alternatively, containers 32 can be routed to dunnage dispensers 12 without detecting an identifier for the container, either at the void volume data acquisition apparatus 11 or at the dunnage dispenser 12, or anywhere in the system 10. Since the void volume data acquisition apparatus acquires the void volume data for containers provided to the void volume data apparatus in sequence, that data or related data representative of the amount of dunnage material to be dispensed can be communicated directly to the dunnage dispenser to which the container is routed. Thus, if three containers 32*a*, 32*b* and 32*c* pass through the void volume data acquisition apparatus 11 in sequence, data can be communicated to the respective dunnage dispenser 12 to which each container 32 is routed without ever reading a bar code label on the containers. In this case, the void volume data is associated with a particular container by its place in a sequence and the routing of the container to a particular dispenser.

Figure 3:
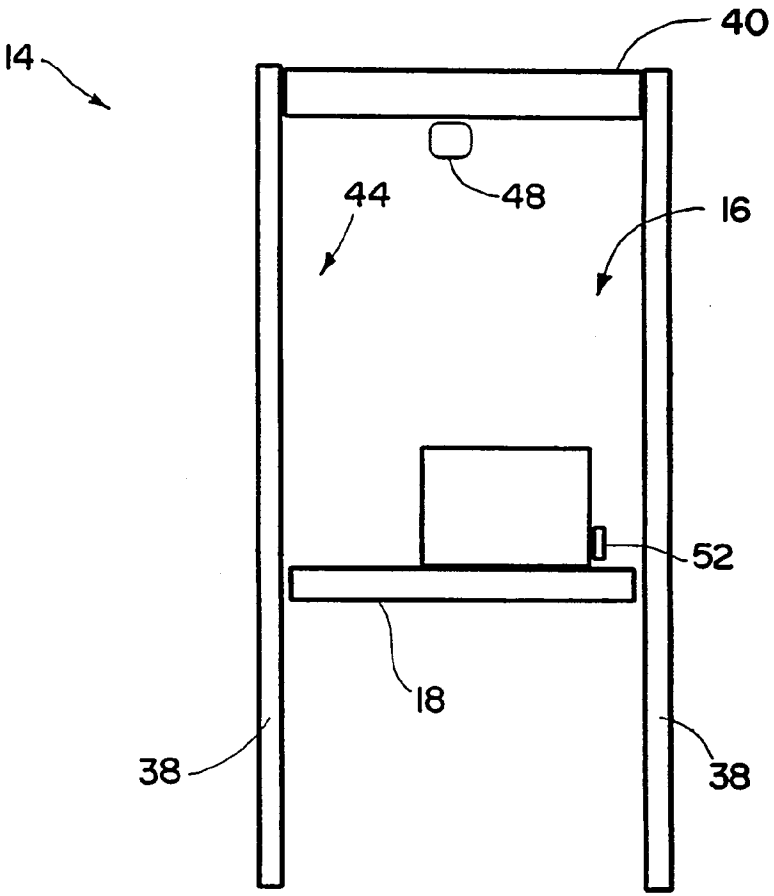
FIG. 3 is an end view of the void volume scanner of FIG. 2, looking from the line 3-3 of FIG. 2.
Figure 2:
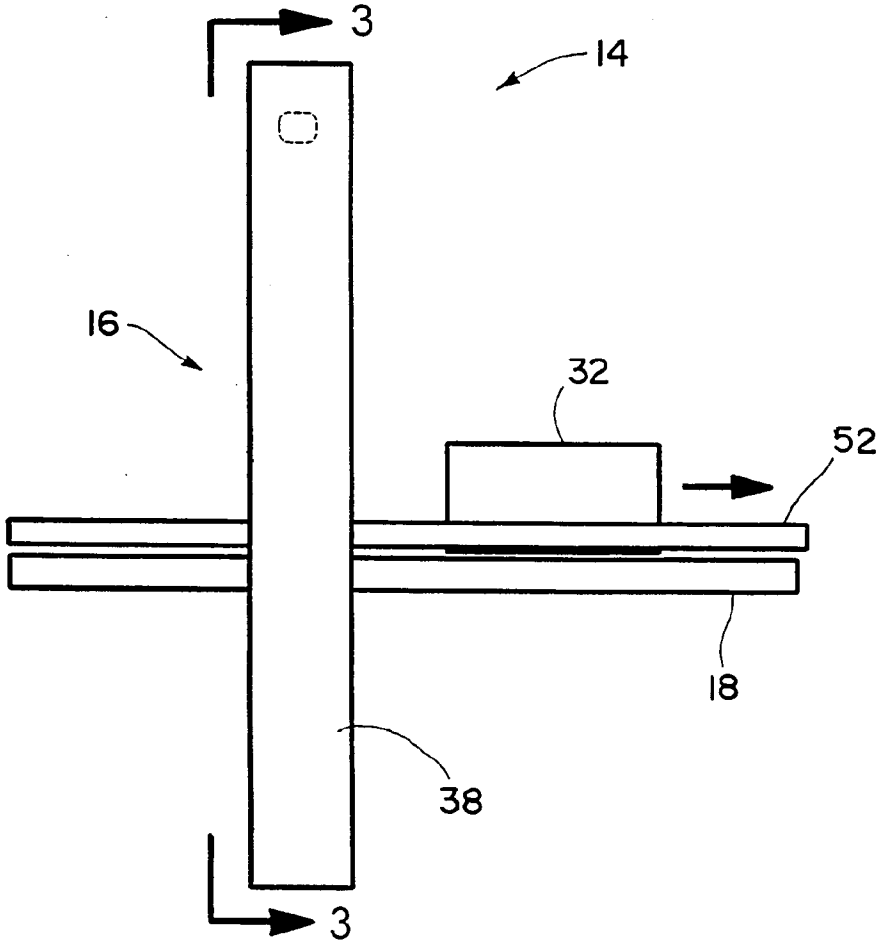
FIG. 2 is a schematic of a void volume scanner used in the system of FIG. 1.

In FIGS. 2 and 3, an exemplary container scanner 14 can be seen to include a frame 38 having a pair of uprights straddling the container conveyor 18 and a cross beam 40 supported atop the uprights at a fixed distanced from the container conveyor 18. The uprights, for example, can be floor supported as shown in FIGS. 2 and 3, or can be mounted to the conveyor 18 as illustrated in FIG. 1.

The container scanner 14 includes one or more sensors, which can be infrared, ultrasonic, laser or other type of sensors, for obtaining data representative of the volume of the empty space or void in a container in which one or more articles have been placed for packing. In the illustrated embodiment, the sensors include a contour sensor 48 for providing an output representative of a contour of the container 32, particularly its interior and the one or more articles in the container.

The contour sensor 48, shown mounted to the cross beam 40 above the scan area 16, preferably but not necessarily is of a type that continuously senses the top surface of the container and the one or more articles in the container, such as container 32*c*, as the container is moved through the scan area 16 by the conveyor 18. An exemplary contour sensor is a non-contact optic laser scanner that operates by measuring the time of flight of laser light pulses, such as the Sick Optic LMS 200-30106 laser scanner. A pulsed laser beam is emitted by the laser scanner and reflected if it meets an article. The reflection is registered by the laser scanner's receiver. The time between transmission and reception of the reflected impulse is directly proportional to the distance between the laser scanner and the article. The pulsed laser beam can be deflected by an internal rotating mirror so that a fan-shaped scan is made of the surrounding area, whereby the contour of the objects in its field of view (i.e., distance from a fixed reference point/plane) can be determined from the sequence of impulses received. The fan beam is oriented perpendicular to the movement path of the container through the scan area 16. Thus the contour of the container and the articles passing through the scan area is progressively measured as the container moves therethrough. As will be appreciated, the measurement data can be supplied in real time via any suitable communication means.

The containers typically are registered against a guide rail 52 on one side of the conveyor 18 which thus functions as a zero reference. Accordingly, the width of the container will be the difference between the location of the guide rail 52 and the measured location of the opposite side of the container. Any suitable means can be employed to register the container against the guide rail 52 or otherwise place the container in a desired consistent orientation for accurate measurement of the container dimensions.

Figure 4:
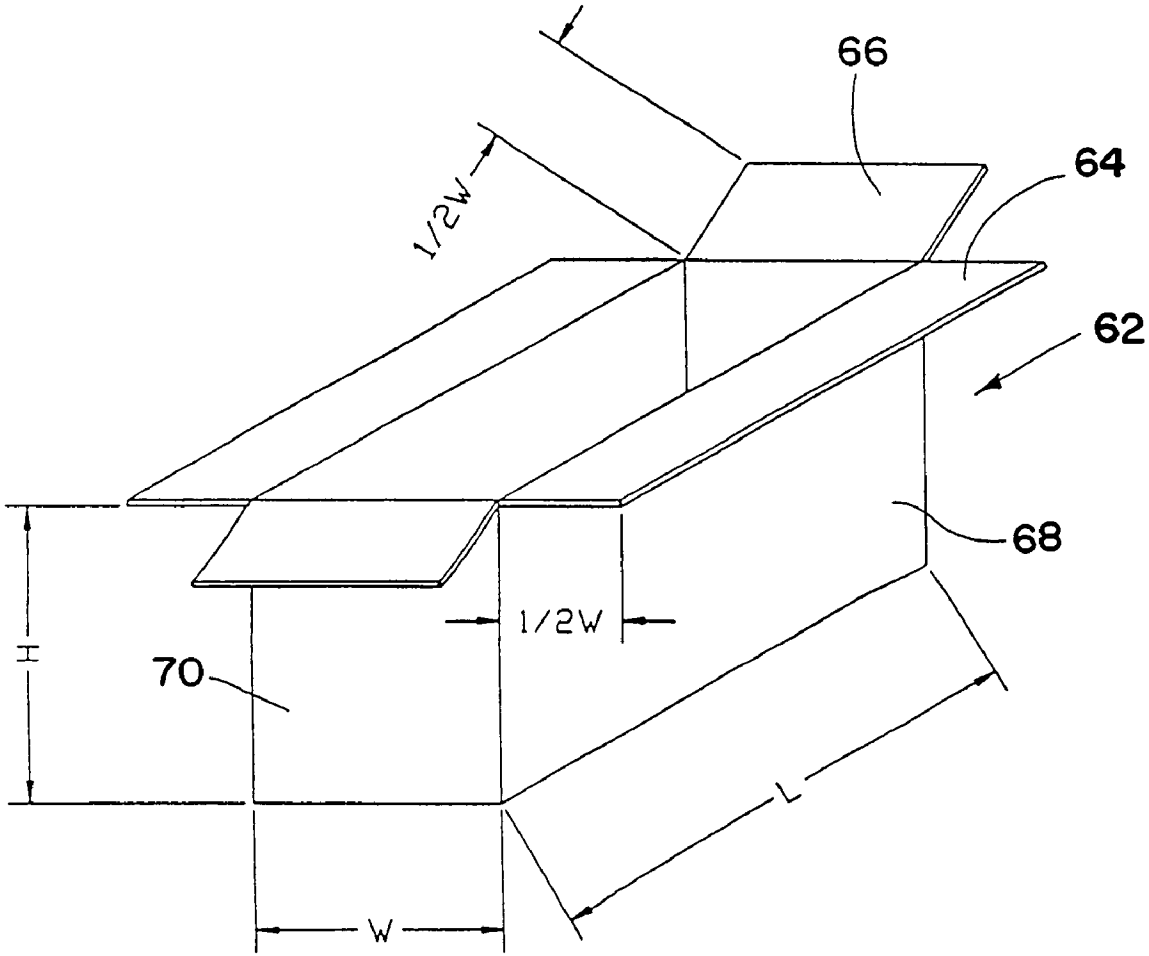
FIG. 4 is a perspective view of a standard regular slotted container (RSC) for use with the system of FIG. 1.

In the illustrated embodiment, the system 10 is configured for use with regular slotted containers (RSCs). As illustrated in FIG. 4, an RSC 62 has a specified relationship between the width of the container W and the height of the side flaps 64 and end flaps 66. That is, the flaps 64 and 66 typically have a height H that is one half the width W of the container, for example. Accordingly, the height H of the side walls 68 and the end walls 70 of the container (i.e., the height of the container when closed) can be determined from a measure of the height of the container with the top flaps 64 and 66 upright in their unfolded state. The height of the side and end walls (the height of the article-containing portion of the container) will be a known fraction of the height of the container when the top flaps 64 and 66 are upright and unfolded. While the illustrated embodiment determines the height of the container with the top flaps 64 and 66 upright and unfolded, those skilled in the art will appreciate that the height H can be determined in other ways, such as when the flaps 64 and 66 are folded down, thereby giving a direct measurement of the height of the side and end walls of the container. The contour sensor 48 also can measure the width of the container.

Separate sensors can be provided to measure the width and/or length of the container, however. The container length can be determined indirectly, for example, by measuring the length of time the container takes to pass the contour sensor and by knowing the speed at which the conveyor 18 moves the container past the sensor. The length of time multiplied by the speed of the conveyor yields the length of the container. If the speed of the conveyor is a known constant, then only the length of time needs to be measured to determine the length of the container. If the speed of the conveyor varies or for other reasons, a conveyor speed sensor 96 can be used to measure the conveyor speed and communicate the same to the control unit 76 for processing. The speed sensor, for example, can be an encoder interfaced with the conveyor drive motor for providing a series of pulses, the rate of which are proportional to the speed of the motor and thus the speed of the conveyor. The control unit can be calibrated to convert the pulse rate to a container speed that can be multiplied with the time measured by the sensor for the container to pass by the sensor to determine the length of the container.

The void volume data acquisition apparatus 11 automatically provides void volume data at a faster rate than the dunnage material would be provided for insertion into each container. Thus, the same void volume data acquisition apparatus 11 can be used to sequentially acquire void volume data that can be used to determine the amount of dunnage material to be dispensed from each of the multiple dunnage dispensers 12. This can improve the throughput through the system, as well as increase the flexibility of the system via the routing criteria. For example, various dunnage dispensers could be dedicated to providing respective void fill densities; serving different shipping destinations; filling different types of void volumes, such as top-fill or deep-void fill; dispensing dunnage at different speeds; filling different size containers, i.e. containers having different heights or openings; or dispensing different types of dunnage material, such as void fill or cushioning, as just a few examples.

Figure 5:
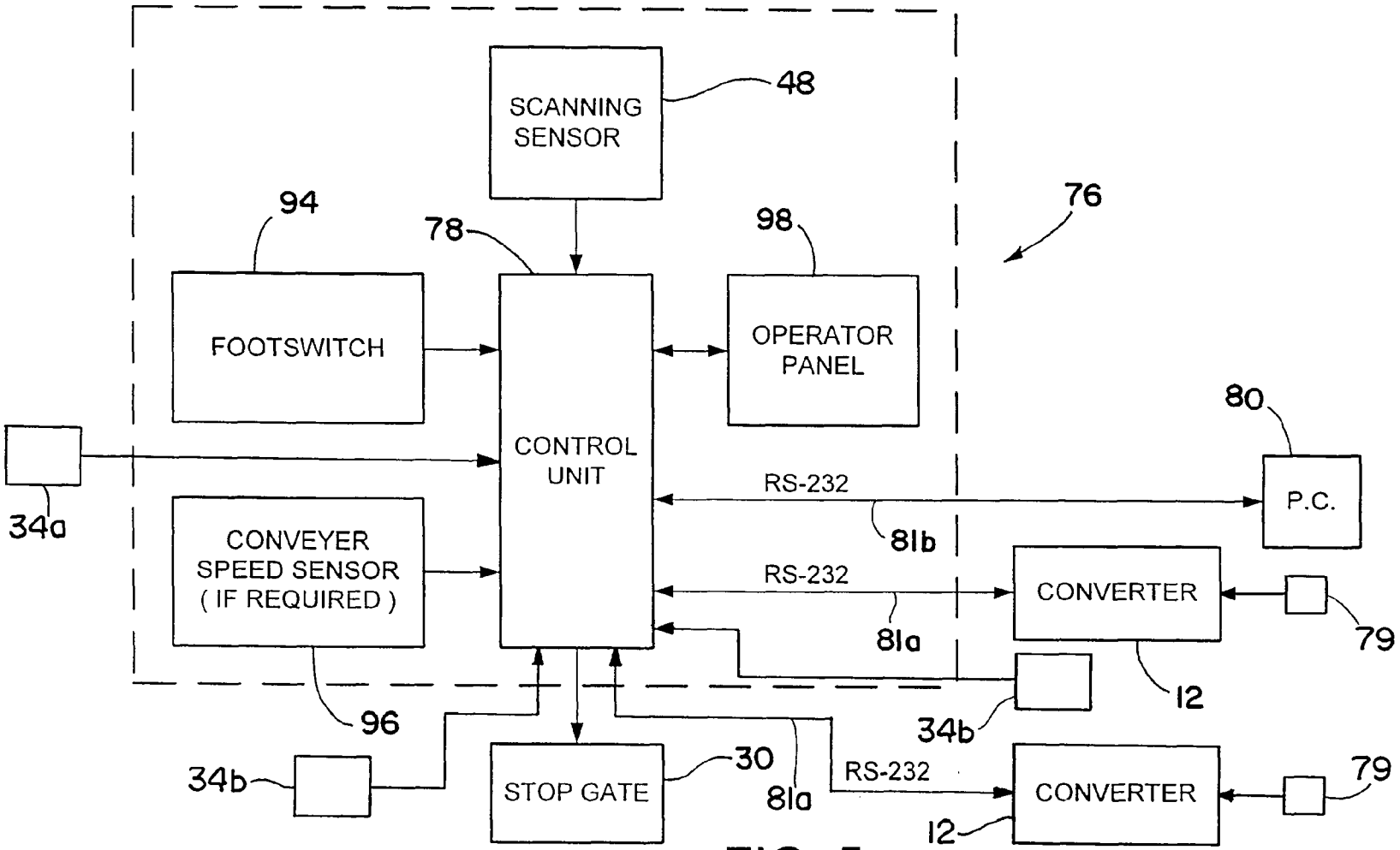
FIG. 5 is a block diagram of a logic device used to control the void-fill measuring and dispensing system of FIG. 1.

The various operative components of the illustrated system 10 are controlled by a logic device 76, which is diagrammatically shown in FIG. 5. The various functions of the logic device 76 can be performed by a single controller, such as a control unit for the container scanner 14, or those functions can be distributed among several controllers, each having separate processors, such as among the control unit 78, one or more controllers for the dunnage dispensers 12, a microprocessor of a personal computer 80 or combinations thereof. The logic device 76 can be located in or near a dispenser 12 or the void volume data acquisition apparatus 11, or can be remotely located.

As used herein, the logic device 76 encompasses the processor or processors that control the operation of the system 10. The processor can be any one of a number of commercially available processors or combinations thereof, such as programmable logic controllers (PLCs) and general purpose processing chips with various output and input ports and associated electronic data storage devices including read-only memory (ROM) and random-access memory (RAM). The logic device also can provide wireless communications capabilities, including cellular, infrared, wireless modem, microwave, radio frequency, satellite communications technology, etc., for remote control, data transfer and other communications purposes. The communications can be one-way or two-way. Wireless communications can be advantageous for remote control, monitoring and diagnostics; updating software; and eliminating or minimizing wiring to and from the system, as but a few examples. The logic device can be controlled by suitable software that among other things uses data received from the sensor to determine container length, width, height and interior contour, and thus the void volume, as well as determining the amount of dunnage material to be dispensed for insertion into that volume, the type of dunnage material to be dispensed and/or the speed at which the dunnage material is dispensed.

Figure 6:
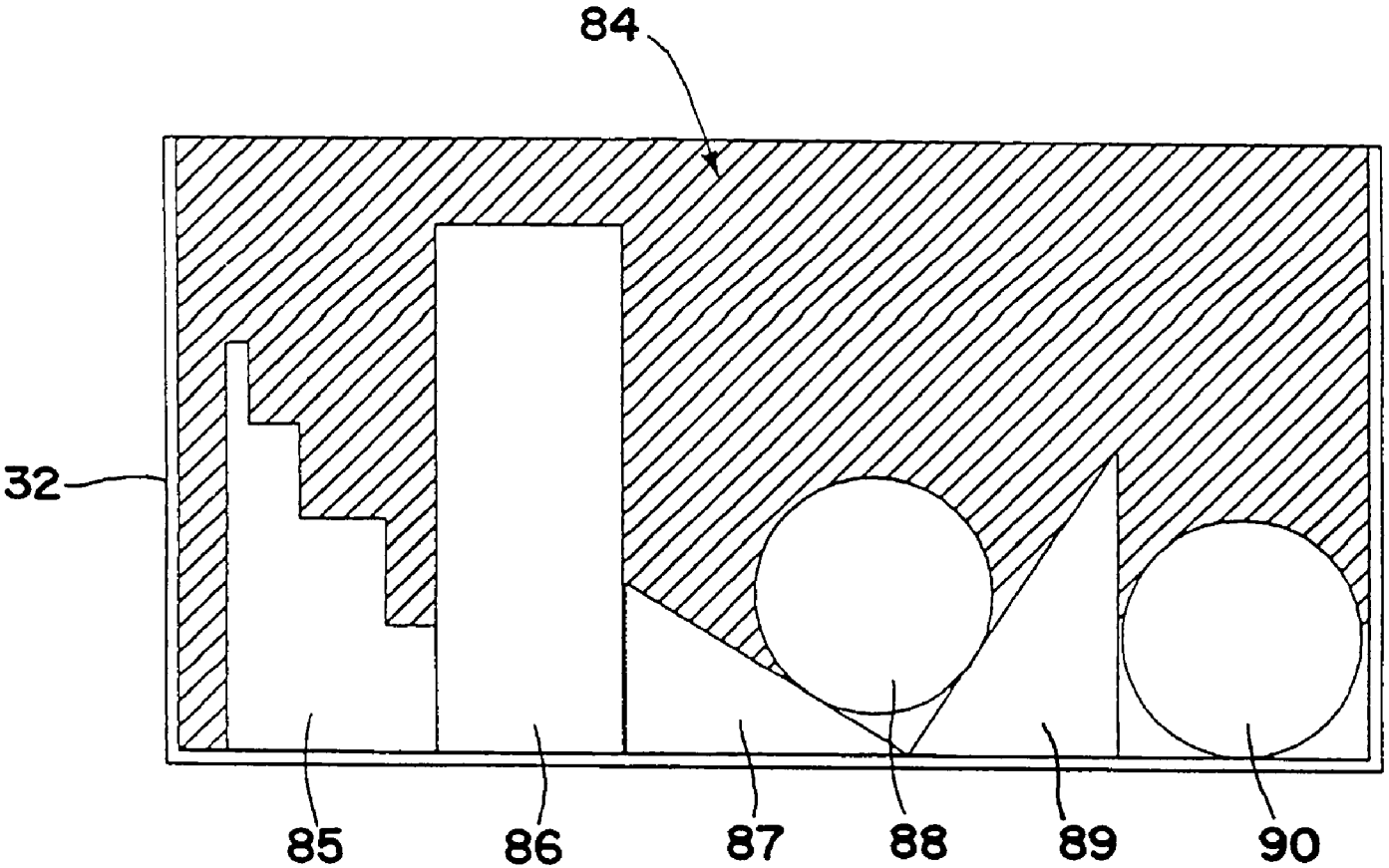
FIG. 6 is a schematic cross-sectional view of a container in which several articles have been placed, with the remaining void being denoted by cross-hatching.

Generally the logic device 76 is operable to process data received from the contour sensor 48 and the speed sensor. The logic device 76 then determines the amount of dunnage material needed to fill the void left in the container when the one or more articles have been placed in the container (or the bottom wall of the container if not overlain by an article). In FIG. 6, this void is illustrated by the cross-hatching 84 while the articles in the container 32 are indicated at 85-90. After the void volume is determined, the logic device 76 can command the dunnage dispenser 12 to dispense automatically the determined amount of dunnage material for that particular container. The dunnage material can flow directly into the container and/or be placed or guided into the container by an operator.

An exemplary dunnage dispenser 12 is a dunnage converter that converts one or more plies of sheet stock material (typically kraft paper) into a relatively less dense dunnage material. Exemplary dunnage converters are shown in U.S. Pat. No. 5,123,889 and in published PCT Patent Application No. PCT/US01/18678, published under International Publication No. WO 01/94107, which are hereby incorporated herein by reference in their entireties. Other types or combinations of multiple types of dunnage dispensers can be used, such as other types of paper dunnage converters, air pillow dispensers, foam-in-place dispensers, dispensers for plastic peanuts, etc., and can include both converters and on-site dunnage storage systems. Many such dispensers can be controlled by microprocessors which can readily be interfaced with the control unit 78 and/or programmed to carry out one or more of the herein described functions of the logic device 76. In the case of a dunnage converter, the dunnage material can be produced on site from a more compact stock material, under operator control via foot switch 79 or automatically in response to a command from the logic device 76.

As illustrated in FIG. 5, the control unit 78 can be interfaced with the dunnage dispensers 12, in this case dunnage converters, and with a personal computer 80 by RS-232 serial connections 81*a* and 81*b*. The control unit 78 is equipped with various input and output ports for communication with the container identification sensors 34*a*, 34*b*, with the contour sensor 48, with a foot switch 94, with a conveyor speed sensor 96, with the stop gate 30 and with an operator panel 98. As seen in FIG. 1, a foot switch 94 and an operator panel 98 preferably are located in the vicinity of each dunnage dispenser 12 for use by the human operator/packer. Each dunnage dispenser 12 also has associated therewith its own input device, such as the aforementioned foot switch 79, for direct control of the dunnage dispenser.

The logic device 76 also can be equipped with one or more additional input devices such as a mouse, a keyboard, a keypad, a touch screen, a foot switch, etc. For example, the operator panel 98 can be equipped with a touch screen as an input device, or the personal computer 80 can have a touch screen or other input device associated therewith. In this manner, a scan reset input is provided to enable the operator to clear a fault condition or reset the system for some other reason. The operator panel and/or personal computer can have a monitor for displaying the various indicators and/or other information, such as the measured dimension of the container, the total volume of the container, the volume of the contents of the container, an identification of the container and the volume of the void above the container contents. Generally a more detailed operator panel is provided near the container scanner 14 and the operator panel 98 provided at each dunnage dispenser 12 is a simpler status indicator. Their functions will become apparent from the following description of the operation of the system 10.

An exemplary packaging method for providing dunnage material for insertion into containers using the system described herein proceeds in the following manner. As depicted in FIG. 1, one or more containers 32 that contain one or more articles, such as products for shipping, are conveyed sequentially by the conveyor 18 towards the void-fill scanner 14. The containers are justified by suitable means to one side of the conveyor 18, and preferably against the guide rail 52 (FIGS. 2 and 3). The containers 32 are stopped at the holding station 24 by the stop gate 30 before entering the scan area 16. When the operator steps on the foot switch 94, the control unit 78 instructs the stop gate 30 to release the leading container for movement into and through the scan area 16. After the container is released, the stop gate is commanded back to its capture position to prevent the next container from moving to the scan area 16 until later commanded by the logic device 76. Alternatively, the stop gate 30 can be activated in response to another event, such as a container exiting the scan area 16 or passing a sensor downstream of the scan area 16.

As the container moves past the container identification sensor 34*a*, container identification data is obtained for that container. Then, when the container moves through the scan area 16, it is scanned by the contour sensor 48 to obtain void volume data that is associated with the container identification data. After scanning, and before reaching a dunnage dispenser 12, the container 32 can pass another container identification sensor 34*b*.

When the scanner 14 scans the container 32, void volume data obtained therefrom is associated with the container identification data. This set of data can be stored in an electronic data storage device, which can be part of the control unit 78, for example. When the subsequent container identification sensor 34*b* senses the identifier on the container 32, the void volume data associated with the respective container identification data can be retrieved from the electronic storage device and transmitted to the respective dunnage dispenser 12.

From the scan area 16, the container may be directed to a holding area similar to the holding station 24 or directed to the packing area 26 where the container stops and is positioned, either automatically or by an operator, in front of the outlet of the dunnage dispenser 12. After the prescribed amount of dunnage material has been dispensed, either directly into the container or to the operator for placement in the container, the container 32 can be passed on for further processing, such as through a container closer 102 and then onto a further portion of the conveyor 104.

The status of the operation can be indicated by suitable indicators on the operator panel 98. For example, there can be provided a power-on indicator, a scan-complete indicator, a scan-fault indicator, a container identifier and a dispenser-ready indicator. In an exemplary simplified operator panel provided at each dunnage dispenser, only two lights are provided. The simplified operator panel provides an indication to the operator of the status of the system, including ready-to-dispense-dunnage, not-ready-to-dispense-dunnage, and the existence of a fault condition. Thus the simplified operator panel can include a red light (typically recognized as a signal to stop, indicating that the system is not ready to dispense dunnage, and that can flash to indicate a fault condition) and a green light (typically recognized as a signal to go, indicating that the system is ready to dispense dunnage), for example. The foot switch 94 typically is enabled only when the green dispenser-ready light is on. The red dispenser-not-ready light, for example, which can flash to indicate when a non-conforming fault condition is detected, can also act as a button switch that an operator can push to reset the system.

Figure 7:
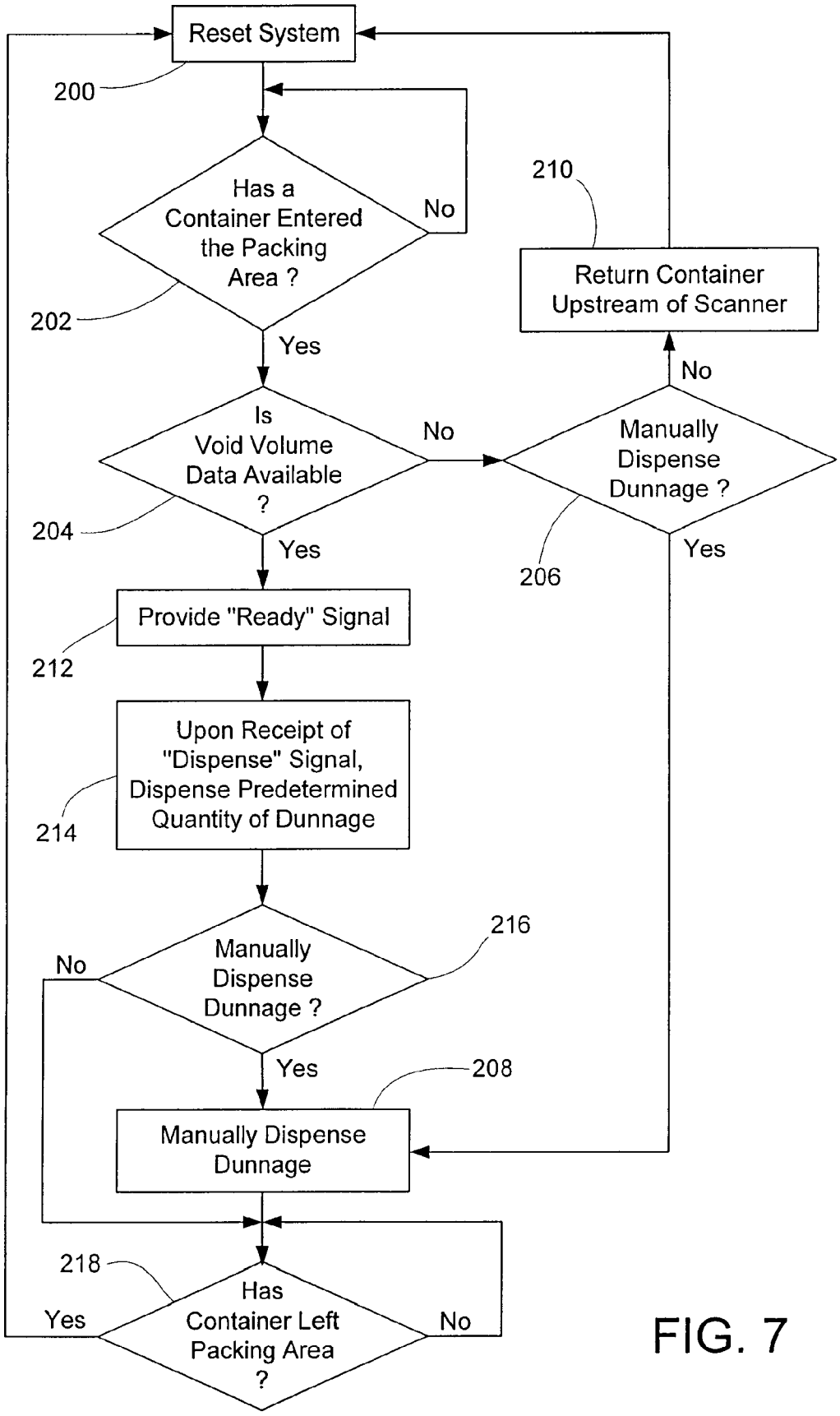
FIG. 7 is a flowchart of an exemplary method for providing dunnage material for insertion into a container.

An exemplary operating sequence once a container arrives at the packing area 26 is shown in FIG. 7. Beginning at step 200, the system is ready. At step 202 the system checks whether a container has entered the packing area 26 (FIG. 1). This can be determined from a proximity sensor, the container passing the aforementioned container sensor 34*b* (FIG. 1), or based on a signal from the operator. The system will wait for a container before proceeding. Next, the system will check to see whether void volume data has been acquired for the container, and if not a fault condition will be indicated and the red dispenser-not-ready light will flash. The operator may use the foot switch 79 to manually dispense dunnage to the container via steps 204 and 206 as further explained below, or may return the container upstream of the void volume data acquisition device 11 via step 210. The operator will then press the flashing red dispenser-not-ready light to reset the system for the next container and return to step 200.

If the void volume data is available and no fault condition exists, the green dispenser-ready light will turn on and the red dispenser-not-ready light will turn off at step 212 to signal the operator that the system is ready to dispense dunnage for the container in the packing area. The operator then steps on the foot switch 94 at step 214 to signal the control unit 78, and in response to the signal from the foot switch 94 the control unit 78 commands the dunnage dispenser 12 to dispense the predetermined quantity of dunnage material associated with the container.

When the operator steps on the foot switch 94 the green dispenser-ready light turns off and the red dispenser-not-ready light will turn on. The foot switch 94 can be deactivated at this point. Alternatively, the switch can be programmed so that the operator can step on the foot switch 94 again to stop the dispenser, for example to catch up to the dispenser and position the dunnage in the container. When the operator steps on the foot switch again the dunnage dispenser will continue dispensing the predetermined quantity of dunnage and then automatically stop. Once the predetermined quantity of dunnage has been dispensed, the foot switch is deactivated.

If the operator determines at step 216 that additional dunnage is needed to fill the void volume in the container, the operator can choose to manually dispense additional dunnage at step 206 using the foot switch 79 that controls the dunnage dispenser directly. The dunnage may settle more than expected or be damaged or become compressed as it is fed into the container, leaving additional space for added dunnage, or the predetermined quantity may be less than what the operator determines is required.

The system will not reset itself until the container leaves the packing area, as shown at step 218. A proximity sensor or container sensor downstream of the dunnage dispenser can be provided for this purpose.

The system thus avoids problems previously experienced with operators inadvertently pushing the foot switch 94 and causing the dunnage dispenser to dispense dunnage for a subsequent container. This could happen as the operator accidently triggers the foot switch 94 more times than intended, or the operator inadvertently triggering the foot switch 94 when intending to operate the dunnage dispenser manually via the foot switch 79 for the dispenser. Once the dispenser dispenses the predetermined quantity of dunnage for a container that is not yet at the packing area, the sequence of predetermined quantities of dunnage is out of synchronization with the sequence of containers, perhaps without the operator immediately realizing the problem.

A non-conforming fault condition can indicate that no container was detected, a flap of a container partially or completely blocks the view into a container, one or more measured container dimensions is below minimum and/or above maximum, container weight is below a minimum and/or above a maximum, a void volume is negative (no article in the container) or exceeds container volume (container overfull), and/or another problem. A non-conforming fault condition also can indicate a situation that fails to meet predetermined criteria, such as a narrow but deep void volume, that might require special processing by an operator.

Although the invention has been shown and described with respect to certain preferred embodiments, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention can have been disclosed with respect to only one of the several embodiments, such feature can be combined with one or more other features of the other embodiments as may be desired and advantageous for any given or particular application.

The invention claimed is:

1. A packaging method for providing dunnage material for insertion into containers, comprising the following steps:

acquiring void volume data associated with a container in a sequence of a plurality of containers;

determining a prescribed amount of dunnage material for insertion into the container based on the acquired void volume data;

transporting the container to a dispenser of dunnage material;

upon a first signal from a first input device, automatically dispensing the prescribed amount of dunnage material for insertion into the transported container and then deactivating the first input device; and upon a signal from a second input device resetting the first input device and indexing the acquired void volume data to that of a next container in the sequence.

2. A method as set forth in claim 1, wherein the step of acquiring void volume data includes sensing the dimensions of the container and sensing a contour of an interior surface of the container and any articles placed therein.

3. A method as set forth in claim 1, wherein the step of acquiring the void volume data includes the identifying characteristics of the container and consulting a database to determine the void volume.

4. A method as set forth in claim 1, wherein the dispensing step includes converting a stock material into a dunnage product.

5. A method as set forth in claim 4, wherein the converting step includes converting a sheet material into the relatively less dense dunnage material.

6. A method as set forth in claim 1, comprising the steps of storing and retrieving void volume data from an electronic data storage device.

7. A method as set forth in claim 1, comprising the step of communicating between a void volume data acquisition apparatus and a dunnage dispenser.

8. A method as set forth in claim 1, wherein upon a third signal from a third input device, manually dispensing a quantity of dunnage material for insertion into the transported container.

9. A method as set forth in claim 1, wherein the transporting step includes routing each container to a selected one of a plurality of dunnage dispensers along a transport network downstream of the void volume data acquisition apparatus.

10. A packaging system for providing dunnage material for insertion into containers, comprising:

a void volume data acquisition apparatus for acquiring from each of a plurality of containers sequentially supplied thereto, void volume data from which can be determined a prescribed amount of dunnage material for insertion into the container and for associating the acquired void volume data with the container;

a dunnage dispenser operable to dispense dunnage material for insertion into a container transported thereto from the void volume data acquisition apparatus;

a transport network downstream of the void volume data acquisition apparatus for routing each container to a selected one of a plurality of dunnage dispensers arranged along the transport network;

a first input device for controlling the dunnage dispenser to dispense for insertion into the transported container the prescribed amount of dunnage material determined from the acquired void volume data associated with the transported container;

a second input device for indexing the void volume data for a next container in the sequence; and a logic device, a first container identification sensor adjacent the void volume data acquisition device to acquire container identification data from each container, wherein the second input device includes a second container identification sensor adjacent each dunnage dispenser to acquire container identification data for each container routed to the dunnage dispenser, the logic device being operable to associate void volume data with container identification data for each container and in communication with each dunnage dispenser to provide the associated void volume data to the dunnage dispenser.

11. A system as set forth in claim 10, wherein the void volume acquisition apparatus includes a sensor for identifying a characteristic of the container.

12. A system as set forth in claim 10, wherein the void volume data acquisition apparatus includes a container identification sensor for identifying containers and a void volume scanner positioned adjacent the container identification sensor that is capable of measuring dimensions representative of the void in the container.

13. A system as set forth in claim 10, wherein the dunnage dispenser includes a supply of dunnage having at least one of air bags, crumpled paper, foam strips, foam peanuts, and paper strips.

14. A system as set forth in claim 10, wherein the dunnage dispenser includes a conversion machine that converts a stock material into the dunnage material.

15. A system as set forth in claim 10, comprising a transport network for conveying containers from the void volume data acquisition device to the dunnage dispenser.

16. A system as set forth in claim 10, comprising a conveyor extending from the void volume data acquisition apparatus to the dunnage dispenser for transporting the containers thereto.

17. A system as set forth in claim 10, comprising at least one controller that determines the amount of dunnage material to be dispensed based on the void volume data, the controller being in a chain of communication between the void volume data acquisition apparatus and the dunnage dispenser.

18. A system as set forth in claim 10, wherein the first input device includes at least one foot pedal and the second input device includes a button switch.

* * * * *